United States Patent [19]

Little

[11] 3,955,241

[45] May 11, 1976

[54] CAM OPERATED SPRING BIASED COUNTERBALANCE HINGE MECHANISM FOR CABINET LID OR THE LIKE

[75] Inventor: Carl H. Little, Jamestown, N.Y.

[73] Assignee: Weber-Knapp Company, Jamestown, N.Y.

[22] Filed: Oct. 16, 1975

[21] Appl. No.: 622,875

[52] U.S. Cl. ..... 16/180; 16/154; 16/171; 49/237; 16/186

[51] Int. Cl.[2] ..... E05F 1/12

[58] Field of Search ..... 16/128 R, 137, 171, 16/145, 180, 182, 186, 152, 153, 154, 163, 164, 191, 49, 53, 71, 181

[56] References Cited

UNITED STATES PATENTS

| | | | |
|---|---|---|---|
| 3,289,244 | 12/1966 | Carey | 16/154 |
| 3,496,595 | 2/1970 | Larson | 16/186 X |
| 3,626,547 | 12/1971 | Werner | 16/154 |

*Primary Examiner*—G. V. Larkin
*Attorney, Agent, or Firm*—Bean & Bean

[57] ABSTRACT

A counterbalance hinge mechanism for a cabinet lid includes a stationary cabinet affixed hinge rod serving to rotatably support a pair of axially stationary lid mounting cam members and to slidably support a pair of non-rotatable cam followers. An adjustable spring assembly serves to bias the cam followers into engagement with the cam members, whereby to counterbalance gravity induced torque effects of the lid throughout a substantial portion of lid opening movement.

10 Claims, 5 Drawing Figures

CAM OPERATED SPRING BIASED COUNTERBALANCE HINGE MECHANISM FOR CABINET LID OR THE LIKE

SUMMARY OF THE INVENTION

The present invention is directed towards an improved counterbalance hinge mechanism for use in removably mounting a lid or the like for vertical swinging movements relative to a cabinet.

In the preferred form of the present invention an elongated hinge pin has its opposite ends removably and non-rotatably fixed to a cabinet. A pair of cam members, which are adapted to be rigidly fixed to a lid, are carried by the hinge pin intermediate its ends for relative rotational movement, while being constrained against relative separating movements axially of the hinge pin. A pair of cam follower members are supported by the hinge pin intermediate the cam members, such that they are constrained against rotational movements relative to the hinge pin while being allowed to undergo reciprocating or sliding movements axially thereof. A counterbalance or compression spring device is disposed concentrically of the hinge pin in end bearing engagement with the cam follower members for the purpose of biasing same in opposite directions into cooperative engagement with associated ones of the cam members.

The cam members are configured to provide for counterbalancing of the weight of the lid essentially throughout its full range of vertical swinging movements, while providing for zero counterbalancing effects at some open position of the lid at which the lid center of gravity is arranged essentially above the support or hinge pin, for example, a lid angle of essentially 90°. While in this lid open position, which in the illustrated construction is an intermediate open position, the hinge pin and thus the lid may be installed or removed from the cabinet without having to contend with either compression spring or lid torque induced force or reaction effects between the hinge pin and cabinet.

DRAWINGS

The nature and mode of operation of the present invention will now be more fully described in the following detailed description taken with the accompanying drawings wherein.

DETAILED DESCRIPTION

Figure 1:
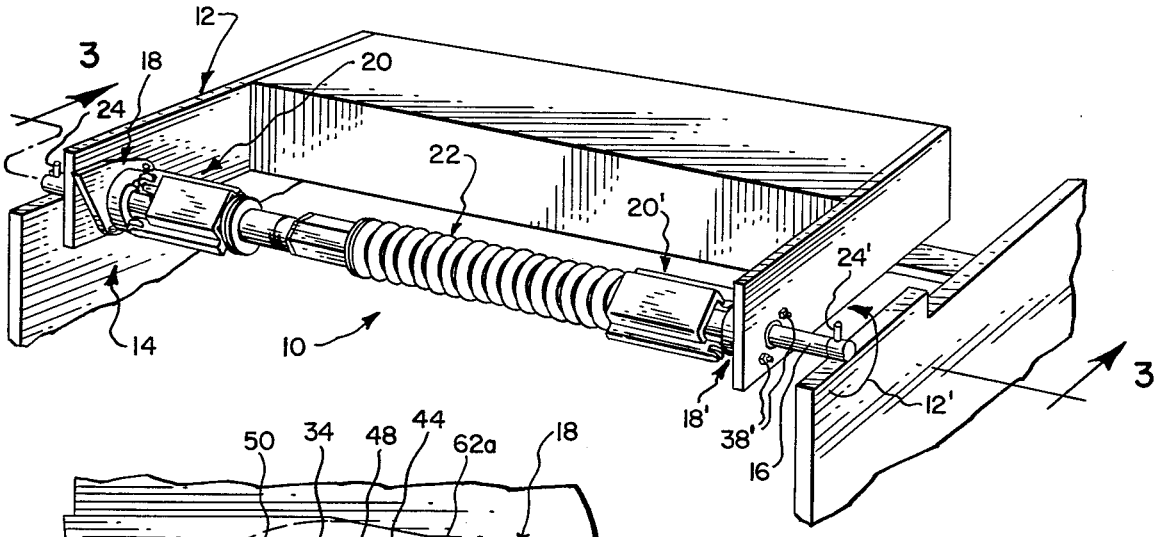
FIG. 1 is a perspective view of the counterbalance hinge mechanism of the present invention illustrating the manner in which it serves to attach a vertically swinging lid or the like to a cabinet.
Figure 2:
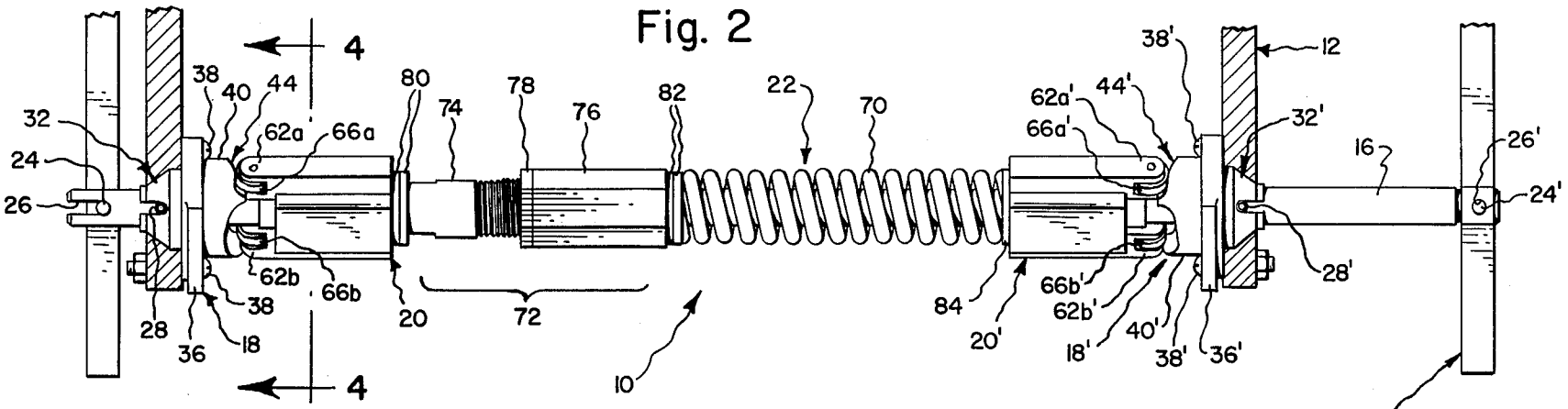
FIG. 2 is a top plan view of the counterbalance mechanism.

Reference is now made particularly to FIGS. 1 and 2, wherein the counterbalance assembly of the present invention is generally designated as 10 and shown as being employed to hingedly mount a lid, shown in part at 12, for vertical swinging movements relative to a cabinet 14 between a first or essentially horizontal lid closed position, which is shown in the drawing and a second or non-illustrated lid open position. In the illustrated form of the invention, lid 12 is arranged to swing upwardly in the direction indicated by arrow 12' and assumes lid opening angles of essentially 0° and 130°, when in its first and second position, respectively. Mechanism 10 will be understood as generally including a hinge pin or rod 16; a pair of cam members 18, 18'; a pair of cam follower members 20, 20'; and an adjustable spring assembly 22.

In the preferred form of mechanism 10, hinge pin 16 is of circular cross sectional configuration and non-rotatably fixed to extend horizontally within cabinet 14 by a pair of parallel pin devices 24 and 24', which are suitably fixed to upstand from cabinet 14 and dimensioned to be removably inserted or slidably received within an end opening slot 26 and a radially through aperture 26', respectively, formed in opposite ends of the hinge pin.

Figure 3:
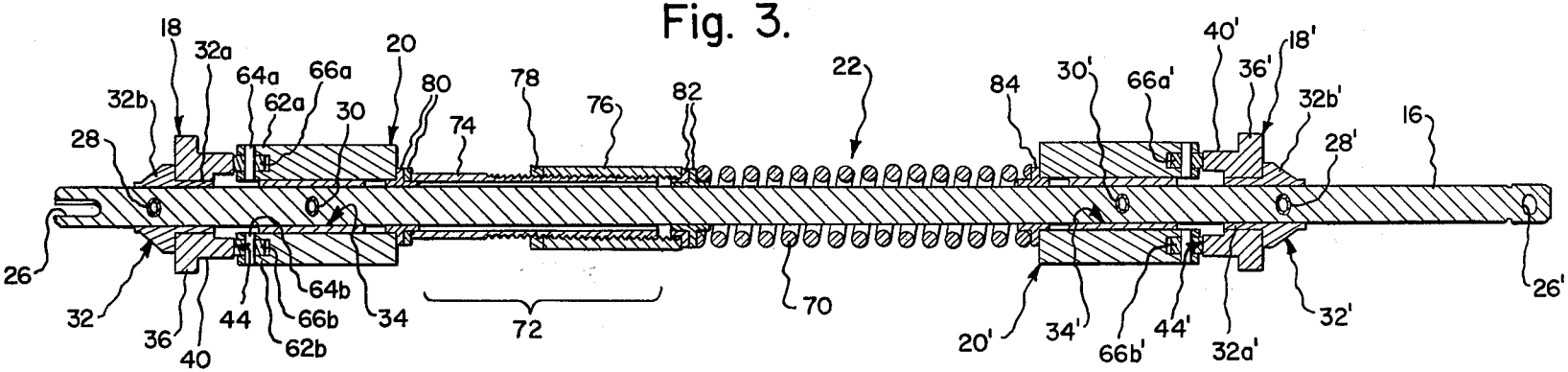
FIG. 3 is a sectional view taken generally along the line 3—3 in FIG. 1.

Hinge pin 16 is shown in FIG. 3 as also being radially through bored to receive a first pair of retaining pins 28 and 28' and a second pair of retaining pins 30 and 30', which serve to fix a pair of stop-bearing sleeve devices 32 and 32' and a pair of guide-bearing sleeve devices 34 and 34', respectively, against both rotational and oppositely directed axial movements relative to the hinge pin.

Cam members 18 and 18' are of mirror image construction and include radially extending mounting flanges or base portions 36 and 36', which are apertured to receive mounting or attachment devices 38 and 38' by which the cam members may be rigidly affixed to lid 12; and tubular or sleeve shaped cam portions 40 and 40'. Flange portions 36 and 36' are internally dimensioned to be rotatably received or journaled upon bearing sleeve portions **32*a* and 32*a'* of stop-bearing sleeve devices 32 and 32' and arranged to axially abut against stop portions 32*b* and 32*b'* of the stop-bearing sleeves in order to constrain the cam members against oppositely directed axially movements relative to hinge pin 16**, while permitting relative rotational movements therebetween.

In that facing end or cam surfaces 44 and 44' of cam portions 40 and 40', respectively, are of mirror image construction, only cam surface 44 will be described in detail with reference to FIG. 5. More specifically, cam surface 44 is formed with a pair of 180° offset, identical cam surfaces **46*a* and 46*b* having lid closed and lid open stop surfaces 48 and 50, respectively, which are arranged to extend essentially axially of shaft 16; and a pair of counterbalance or camming surfaces 52 and 54, which are arranged to extend in a smoothly curved, converging relationship relative to the axis of the hinge pin from adjacent stop surfaces 48 and 50, respectively, towards intermediate "inactive" or "dwell" surfaces 56, which in turn extend generally transversely of the axis of the hinge pin. In the illustrated construction, stop surfaces 48 and 50 of each of cam surfaces 46*a* and 46*b* are annularly spaced through approximately 130° and each "inactive surface" 56 is annularly spaced from its associated lid closed stop surface 48 through approximately 90°. As will be more fully described, the annular position of inactive surfaces 56 for any given mechanism will be determined by the design of lid 12 and will correspond essentially to the lid opening angle at which the center of gravity of the lid is disposed above mechanism 10, i.e., passes vertically through the axis of hinge pin 16. In the illustrated construction, counterbalance surfaces 52 are operative for a range of lid opening angles below about 90° for counterbalancing gravity induced lid torque effects, which are directed in a clockwise direction about the axis of hinge pin 16, as viewed in FIGS. 1, 4 and 5, whereas counterbalance surfaces 54 are operative for a range of lid opening angles above about 90° for counterbalancing gravity induced lid torque effects, which are directed counter-clockwise about the axis of the hinge pin, also as viewed in FIGS. 1, 4 and 5**.

In that cam follower members 20 and 20' are of identical construction, only cam follower member 20 will be described in detail making specific reference to FIGS. 2, 3 and 4. Specifically, cam follower member 20 is formed with an axial through opening 60, which is of "non-round" cross-sectional configuration and sized to slidably receive the like configured outer surface of guide-bearing sleeve device 34; this arrangement serving to support the cam follower member 20 for sliding or reciprocating movements in a direction axially of hinge pin 16, while constraining the cam follower member against rotation relative to the hinge pin. By "non-round" is meant a configuration other than round, which will serve to constrain relative rotational movements between cam follower member 20 and sleeve device 34. The most practical "non-round" configuration would appear to be a "square," but a rectangle or oval configuration could be employed. Further, cam follower member 20 is formed with a pair of fabricated ears 62*a* and 62*b*, which are arranged in an essentially 180° offset relationship and through-bored to receive axially aligned pin shafts 64*a* and 64*b*. Pin shafts 64*a* and 64*b* serve to rotatably support cam follower elements in the form of thrust rollers or wheels 66*a* and 66*b*, which are arranged to bear against cam surfaces 46*a* and 46*b*, respectively.

Assembly 22 is best shown in FIGS. 2 and 3 as generally comprising a compression spring 70; and a spring adjustment device 72 including an externally threaded sleeve 74, an internally threaded adjustment nut 76 and an internally threaded lock nut 78. Assembly 22 further includes bearing-thrust washer devices 80, which are arranged axially intermediate sleeve 74 and cam follower member 20 and serve to support the former concentrically of hinge pin 16; bearing-thrust washer devices 82, which are arranged axially intermediate adjustment nut 76 and one end of spring 70 and serve to support their adjacent disposed ends concentrically of the hinge pin; and a bearing-thrust washer device 84, which is arranged axially intermediate an opposite end of spring 70 and cam follower member 20' and serves to maintain such opposite end concentrically of the hinge pin. As will be apparent from viewing FIG. 3, the threading of adjustment nut 76 onto sleeve 74 in directions towards and away from cam follower member 20 serves to decrease and increase, respectively, the degree to which spring 70 is compressed. It will also be apparent by viewing FIG. 3 that assembly 22 serves to normally bias cam follower members 20 and 20' for movement in opposite directions, whereby to maintain thrust rollers 66*a*, 66*b* and 66*a'*, 66*b'* in camming or bearing engagement with cam surfaces 44 and 44', respectively, as cam members 18, 18' are caused to rotate relative to cam follower members 20, 20' during opening and closing movements of lid 12.

Before describing the operation of mechanism 10 in detail, it is believed helpful to first point out that the spring force developed by spring 70 is directed in alignment with the axis of hinge pin 16. Thus, no counterbalance moment is produced by mechanism 10 when the thrust rollers are arranged to bear upon "inactive" surfaces 56, due to the fact that these surfaces extend transversely of the axis of the hinge pin. Counterbalance moments are produced, however, when the thrust rollers are arranged to bear against counterbalance surfaces 52 and 54 in that these surfaces are inclined relative to the axis of the hinge pin, thereby permitting a vector component of spring force to be developed which acts on cam surfaces 46*a* and 46*b* in a direction extending transversely of the axis of the hinge pin. Further, it will be understood that, since surfaces 52 and 54 converge or have opposite slopes, the directions of the counterbalance moments resulting from engagement of the thrust rollers therewith will be opposite. Also, it will be understood that, since cam surfaces 46*a* and 46*b* are disposed concentrically of the axis of hinge pin 16, the moment arm through which the above mentioned component of spring force acts is constant. Thus, the counterbalance moments developed by mechanism 10 will change directions as the thrust rollers roll between surfaces 52 and 54 and will vary in value with the value of spring force exerted by spring 70 and the configurations of surfaces 52 and 54, i.e., the slope profiles of these surfaces relative to the axis of hinge pin 16.

In that the mode of operation of cam follower members 20 and 20' with their associated cam members 18 and 18' is identical, reference will be made only to the operation of cam follower member 20 and cam member 18 in order to facilitate description of the mode of operation of mechanism 10. Description will also be facilitated by assuming in the first instance that lid 12 is closed or essentially horizontally disposed such that the initial lid opening angle is essentially 0°. In this position of lid 12, thrust rollers 66*a* and 66*b* are disposed in engagement with counterbalance surfaces 52 and arranged in contact with lid closed stop surfaces 48, or alternatively immediately adjacent these stop surfaces when other abutment means, not shown, are employed to define the closed position of the lid. It will be understood that the portion of surfaces 52 arranged adjacent lid closed stop surfaces 48 constitutes "high points" of cam surfaces 46*a* and 46*b* and thus spring 70 is maintained under a higher degree of compression when lid 12 is in first or closed condition, than at any other point between lid closed and intermediate positions. If surfaces 52 were of constant scope throughout their lengths, the spring force acting through cam follower member 20 on cam member 18 would produce a first maximum counter-clockwise directed counterbalance moment, when lid 12 is in closed position. However, it is preferable to keep the counterbalance moment relatively small near the lid closed position to prevent any racking of the lid, and thus the "high points" of surfaces 52 would have little, if any, slope. The slope of sufaces 52 would, however, increase substantially immediately adjacent their "high points" to provide a substantial counterbalance moment, as soon as the lid undergoes a slight opening movement.

Figure 4:
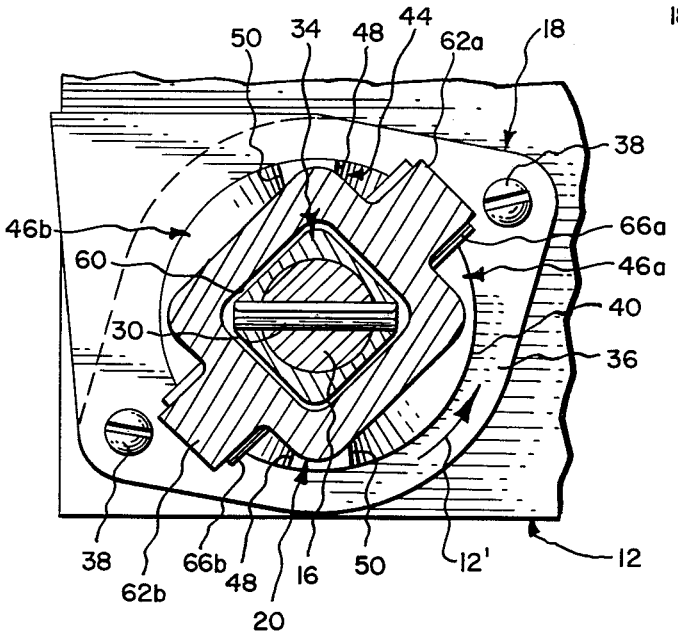
FIG. 4 is a sectional view taken generally along line 4—4 in FIG. 2.
Figure 5:
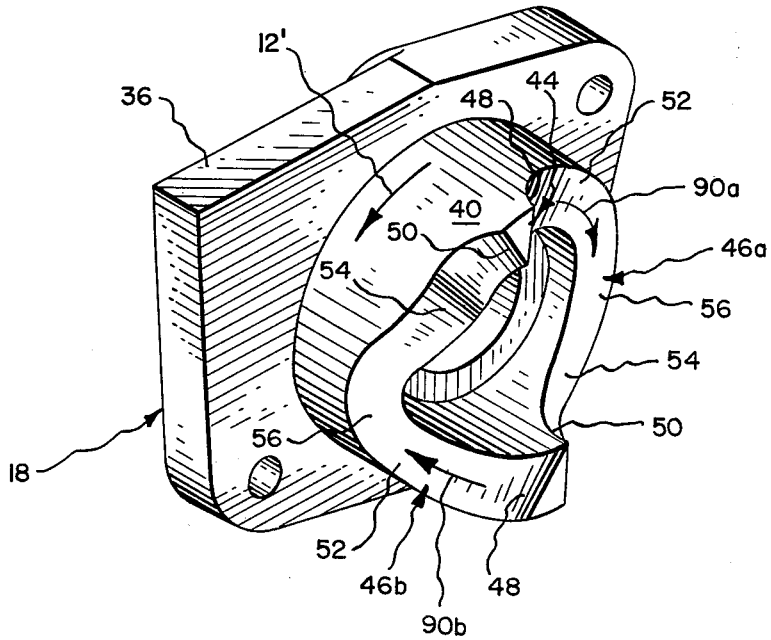
FIG. 5 is an enlarged perspective view of a lid mounting cam member.

As lid 12 is swung upwardly in the direction indicated by arrows 12' in FIG. 1, 4 and 5, cam member 18 undergoes rotary movement relative to cam follower member 20, thereby permitting thrust rollers 66*a* and 66*b* to "roll down" counterbalance surfaces 52 in the direction indicated by arrows 90*a* and 90*b* in FIG. 5, towards "inactive" surfaces 56, which in turn constitute "low points" of cam surfaces 46*a* and 46*b*. Thus, rotation of cam member 18 permits movement of cam follower member 20 towards its associated end of hinge pin 16 with the result that spring 70 is permitted to progressively expand, whereby to progressively decrease counterbalance effects. Counterbalance effects become zero as a result of rollers 66*a* and 66*b* being arranged in engagement with "inactive" surfaces 56. In that it is normally preferable to provide a stable intermediate lid open position, spring 70 would be constantly maintained in a compressed state in order that it may be effective in establishing counterbalance moments immediately adjacent opposite sides of such intermediate position. The configuration of counterbalance surfaces 52 and the force exerted by spring 70 may be selected as required to counterbalance or essentially counterbalance the gravity induced, clockwise directed torque effects acting on lid 12, which vary from some first maximum value when the lid is in closed condition to zero when the lid is "over center" or arranged in an intermediate open position wherein its center of gravity passes vertically through the axis of hinge pin 16. By properly choosing the annular positioning of "inactive" surfaces 56, the zero counterbalance moment condition of mechanism 10 may be matched with the zero gravity induced torque condition of lid 12. When this matching of zero conditions occurs, there is an absence of both counterbalance moment and lid torque induced reaction forces existing between hinge pin 16 and pin devices 24 and 24', thereby permitting mechanism 10 and lid 12 to be simply lifted from or installed on cabinet 14 without the use of tools. However, certain installations may require that lid opening movements be limited to a value less than 90° and in this case counterbalance surfaces 54 would be dispensed with and counterbalance surfaces 52 would be shaped (or a stop provided) to render the mechanism inactive upon movement of the lid into its limited open position. This would permit removal of the lid in the absence of counterbalance moment induced reaction forces, although lid torque induced reaction forces would remain.

Upon continued opening movements of lid 12 beyond its above described intermediate open position in the direction indicated by arrow 12' in FIGS. 1, 4 and 5, thrust rollers 66a and 66*b* are forced to "roll up" on counterbalance surfaces 54, whereby to effect progressive compression of spring 70 until such time as the rollers engage other "high points" of cam surfaces 46*a* and 46*b*, which are arranged adjacent lid open stop surfaces 50. Continued lid opening movements in the direction indicated by arrows 12' is thereafter prevented by engagement of thrust rollers 66*a* and 66*b* with stop surfaces 50, or alternatively by engagement of lid 12 with a suitable stop device, not shown. It will be noted that during this continued opening movement of lid 12, the gravity induced torque effects acting thereon progressively increase from zero towards some second maximum value and are opposite in direction to the direction of the gravity induced torque effects acting on lid 12, during movement thereof between its lid closed position and its intermediate open position. It will also be understood that the counterbalance effects, which result from spring 70 being progressively compressed as rollers 66*a* and 66*b* roll up on counterbalance surfaces 54, increase from zero to some second maximum value and are opposite in direction to the counterbalance effects produced by mechanism 10, during opening movements of the lid beween its closed and intermediate open position. Of course, the configuration of counterbalance surfaces 46*a* and 46 *b* may be tailored to permit complete or partial counterbalancing of lid 12 during movements thereof between its intermediate and fully open positions. It will be understood that in the illustrated construction, the maximum values of lid torque and counterbalance moment adjacent the lid closed position exceed those adjacent the lid open position, but this relationship may be varied depending upon the relative angular spacing of the lid closed and open positions from the intermediate position.

While the preferred construction of mechanism 10 has been disclosed as employing pairs of thrust rollers and associated cam surfaces arranged at opposite ends of a common hinge pin, it will be understood that the invention is not limited thereto. Thus, for installations in which it is undesirable for the hinge pin to extend across the cabinet opening, a pair of axially aligned "short" hinge pins may be employed to replace the common hinge pin in which case a cam, cam follower and spring assembly would be carried on each "short" hinge pin. Also, for certain installations, it would be possible to employ only one of such "short" hinge pins to provide required hinge suppport and counterbalance effects. Further, it will be appreciated that the present invention is not limited to installations, wherein a lid is required to pass over center, since as mentioned above, the lid may have a "limited" fully open position arranged at a lid opening angle of less than 90°. Also, if desired, the fully open position of the lid may be made to correspond with its described intermediate open position by deleting counterbalance surfaces 54 and by arranging stop surfaces 50 adjacent "inactive" surfaces 56. Still further, it will be understood that "inactive" surfaces 56 may be flat to provide for "line" surface contact with rollers 66*a* and 66*b* or may be rounded to provide for "extended surface" contact with such rollers. Alternatively, the "mid points" of the "inactive surfaces" may be recessed to define a "V" in which case the rollers would have a "two line" surface contact.

The term "lid" as used hereinabove and in the claims is intended to be generic and include any member arranged either on or within a cabinet or the like for vertical swinging movements. Thus, the term "lid" is meant to include a conventional cabinet top or cover, which would normally be supported for movement between an open or cabinet interior exposed position and a closed or cabinet interior hidden position, as well as a material/instrument supporting member, which would be arranged within the confines of the cabinet or the like for vertical swinging movements between an operative and inoperative position, as required to permit inspection/maintenance/replacement/resupply of the material or instrument supporting member or afford access to an interior part of the cabinet otherwise blocked by such member.

I claim:

1. A combination hinge and counterbalance mechanism for hingedly mounting a lid on a cabinet for vertically directed swinging movements between first and second positions, said mechanism including:

an elongated hinge pin;

means adapted for removably fixing opposite ends of said hinge pin to said cabinet;

at least one cam member adapted to be fixed to said lid, said cam member being supported on said hinge pin for rotation about the axis thereof, while being constrained against movement in at least one direction axially thereof;

at least one cam follower member associated one with each said cam member, said cam follower member being supported on said hinge pin for reciprocating movements axially thereof while being constrained against rotation relative thereto; and a spring assembly arranged for biasing said cam follower member for movement in said one direction into operative engagement with its associated cam member for counterbalancing the torque effects of gravity on said lid throughout at least a substantial portion of the range of lid swinging movements, said cam member being configured to render said mechanism inactive for counterbalancing said torque effects at a point of lid swinging movements, whereby to permit said hinge pin to be removed from said cabinet when said lid is at said point of lid swinging movement in the absence of counterbalancing induced reaction forces therebetween.

2. A mechanism according to claim 1, wherein said torque effects are essentially zero when said lid is swung into an intermediate position arranged between said first and second positions, said torque effects acting on said lid on opposite sides of said intermediate position being oppositely directed whereby tending to opposed movement of said lid from both said first and second positions into said intermediate position, said cam member defining a cam surface configured to cooperate with said cam follower member to render said mechanism inactive upon movement of said lid into said intermediate position and to provide counterbalance moments acting on said lid upon opposite sides of said intermediate position.

3. A mechanism according to claim 1, wherein a pair of cam members are supported on said hinge pin and constrained against relative separating movements axially thereof, a pair of cam follower members are supported on said hinge pin axially intermediate said pair of cam members and associated one with each of said cam members, and said spring assembly is arranged for opposite end bearing engagement with said cam follower members.

4. A mechanism according to claim 3, wherein said cam members are supported on said hinge pin by a pair of bearing-stop devices, said bearing-stop devices being fixed against rotation and oppositely directed axial movements relative to said hinge pin, each said bearing-stop devices having a sleeve portion extending concentrically of said hinge pin and stop portion extending radially of said hinge pin, said cam members being journaled on said sleeve portion for rotation relative to said hinge pin and arranged to abut against said stop portion to prevent oppositely directed movements thereof axially of said hinge pin, and said cam members including tubular portions defining cam surfaces on facing ends thereof and flange portions extending radially of said tubular portions and adapted to be rigidly fixed to said lid.

5. A mechanism according to claim 3, wherein said cam follower members are supported on said hinge pin by a pair of guide-bearing devices, said guide-bearing devices being fixed against rotation and oppositely directed axial movement relative to said hinge pin, and each of said cam followers is formed with an axially extending through opening having a non-round cross-sectional configuration and sized to slidably receive a like configured outer surface of its associated guide-bearing device.

6. A mechanism according to claim 3, wherein said spring assembly comprises a compression spring and means to adjust the degree to which said compression spring is compressed.

7. A mechanism according to claim 3, wherein said torque effects are essentially zero when said lid is swung into an intermediate position arranged between said first and second positions, said torque effects acting on said lid on opposite sides of said intermediate position being oppositely directed whereby tending to opposed movement of said lid from both said first and second positions into said intermediate position, said cam members defining facing cam surfaces configured to cooperate with said cam follower members to render said mechanism inactive upon movement of said lid into said intermediate position and to provide counterbalance moments acting on said lid upon opposite sides of said intermediate position, each of said cam follower members includes a pair of bifabricated ears arranged in an essentially 180° offset relationship about the axis of said hinge pin, said ears carrying a pair of thrust rollers supported for rotation about aligned axes extending transversely of the axis of said hinge pin, and each of said facing cam surfaces includes a pair of cam surfaces arranged in essentially 180° offset relationship about the axis of said hinge pin and for engagement one with each of said thrust rollers carried by its associated cam follower member, each cam surface of said pair of cam surfaces defining a pair of counterbalance cam surfaces arranged adjacent opposite sides of an "inactive" surface, said counterbalance cam surfaces being inclined relative to the axis of said hinge pin and converging towards said "inactive" surface, a first of said counterbalance cam surfaces of each pair cooperating with its associated one of said thrust rollers to create a counterbalance moment tending to oppose movement of said lid from said intermediate to said first position and second of said counterbalance surfaces of said pair cooperating with its associated one of said thrust rollers to create a counterbalance moment tending to oppose movement of said lid from said intermediate towards said second position, said "inactive" surface of each cam surface being arranged for engagement with its associated one of said thrust rollers to render said mechanism inactive for counterbalancing said torque effects coincident with said intermediate position of said lid.

8. A mechanism according to claim 7, wherein said cam follower members are supported on said hinge pin by a pair of guide-bearing devices, said guide-bearing devices being fixed against rotation and oppositely directed axial movement relative to said hinge pin, and each of said cam followers is formed with an axially extending through opening having a non-round cross-sectional configuration and sized to slidably receive a like configured outer surface of its associated guide-bearing device, and said cam members are supported on said hinge pin by a pair of bearing-stop devices, said bearing-stop devices being fixed against rotation and oppositely directed axial movements relative to said hinge pin, each said bearing-stop devices having a sleeve portion extending concentrically of said hinge pin and a stop portion extending radially of said hinge pin, said cam members being journaled on said sleeve portion for rotation relative to said hinge pin and arranged to abut against said stop portion to prevent oppositely directed movements thereof axially of said hinge pin, and said cam members including tubular portions defining said facing cam surfaces and flange portions extending radially of said tubular portions and adapted to be rigidly fixed to said lid, and said spring assembly comprises a compression spring and means to adjust the degree to which said compression spring is compressed.

9. A mechanism according to claim 3, wherein each of said cam follower members includes a pair of bifabricated ears arranged in an essentially 180° offset relationship about the axis of said hinge pin, said ears carrying a pair of thrust rollers supported for rotation about aligned axes extending transversely of the axis of said hinge pin, and each of said cam members defines a pair of cam surfaces arranged in essentially 180° offset relationship about the axis of said hinge pin and for engagement one with each of said thrust rollers carried by its associated cam follower member, each cam surface of said pair of cam surfaces defining at least one counterbalance cam surface arranged adjacent an "inactive" surface, said counterbalance cam surface being inclined relative to the axis of said hinge pin and cooperating with its associated one of said thrust rollers to create a counterbalance moment for opposing gravity induced torque effects tending to move said lid from said point of lid swinging movements into said first position, said "inactive" surface being arranged for engagement with its associated one of said thrust rollers to render said mechanism inactive for counterbalancing said torque effects coincident with said point of lid swinging movements.

10. A mechanism according to claim 9, wherein said cam follower members are supported on said hinge pin by a pair of guide-bearing devices, said guide-bearing devices being fixed against rotation and oppositely directed axial movement relative to said hinge pin, and each of said cam followers is formed with an axially extending through opening having a non-round cross-sectional configuration and sized to slidably receive a like configured outer surface of its associated guide-bearing device, and said cam members are supported on said hinge pin by a pair of bearing-stop devices, said bearing-stop devices being fixed against rotation and oppositely directed axial movements relative to said hinge pin, each said bearing-stop devices having a sleeve portion extending concentrically of said hinge pin and a stop portion extending radially of said hinge pin, said cam members being journaled on said sleeve portion for rotation relative to said hinge pin and arranged to abut against said stop portion to prevent oppositely directed movements thereof axially of said hinge pin, and each of said cam members including a tubular portion defining said pair of cam surfaces and a flange portion extending radially of said tubular portion and adapted to be rigidly fixed to said lid, and said spring assembly comprises a compression spring and means to adjust the degree to which said compression spring is compressed.

* * * * *